United States Patent [19]

Yates, Jr.

[11] Patent Number: 4,616,566

[45] Date of Patent: Oct. 14, 1986

[54] SECONDARY HIGH EXPLOSIVE BOOSTER, AND METHOD OF MAKING AND METHOD OF USING SAME

[75] Inventor: Donald N. Yates, Jr., Katy, Tex.

[73] Assignee: Halliburton Company, Duncan, Okla.

[21] Appl. No.: 658,266

[22] Filed: Oct. 5, 1984

[51] Int. Cl.[4] ..... F42B 3/00

[52] U.S. Cl. ..... 102/318; 102/275.4; 264/3.4

[58] Field of Search ..... 102/275.4, 275.5, 318; 264/3 C, 3 D, 3.4, 3.5

[56] References Cited

U.S. PATENT DOCUMENTS

| | | | |
|---|---|---|---|
| 1,743,739 | 1/1930 | Turek | 102/20 |
| 2,760,434 | 8/1956 | Ruth | 102/20 |
| 3,655,836 | 4/1972 | Dehm | 264/3 R |
| 3,763,291 | 10/1973 | Loedding | 264/3 R |
| 3,880,080 | 4/1975 | Cook | 102/318 |
| 3,907,947 | 9/1975 | Neuhaus et al. | 264/3 R |
| 3,924,510 | 12/1975 | Strunk et al. | 86/1 R |
| 3,954,062 | 5/1976 | Dunlop et al. | 102/99 |
| 4,145,972 | 3/1979 | Menz et al. | 102/270 |
| 4,282,814 | 8/1981 | Menz et al. | 102/275.5 X |
| 4,361,450 | 11/1982 | Munson | 149/20 X |
| 4,407,200 | 10/1983 | Bender et al. | 102/202.5 |
| 4,411,199 | 10/1983 | Yates et al. | 102/275.4 X |
| 4,428,292 | 1/1984 | Riggs | 149/105 X |
| 4,495,867 | 1/1985 | Mitchell, Jr. et al. | 102/275.7 X |
| 4,519,313 | 5/1985 | Leidel | 102/310 |

FOREIGN PATENT DOCUMENTS 28376 3/1909 United Kingdom .

*Primary Examiner*—Peter A. Nelson

*Attorney, Agent, or Firm*—James R. Duzan

[57] ABSTRACT

An explosive booster which contains a secondary high explosive material of such density that it is capable of receiving a detonation from one secondary high explosive mass, across a discontinuity, and of then detonating and transmitting the detonation to another secondary high explosive mass. The explosive booster is produced by compacting the secondary high explosive material to a density such that the booster is capable of acting as both an acceptor and donor of a detonation. The explosive booster may be used to transfer a detonation from one secondary high explosive mass to another such mass as for example in detonating a string of perforating guns within wellbores in the oil and gas industry.

23 Claims, 5 Drawing Figures

FIG. 1
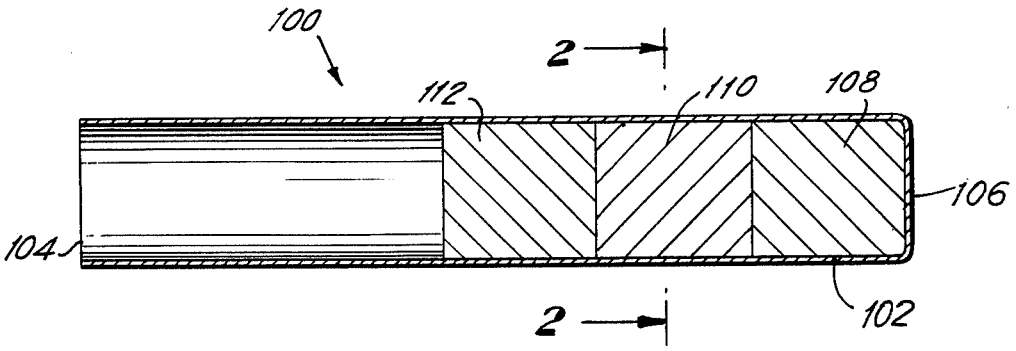
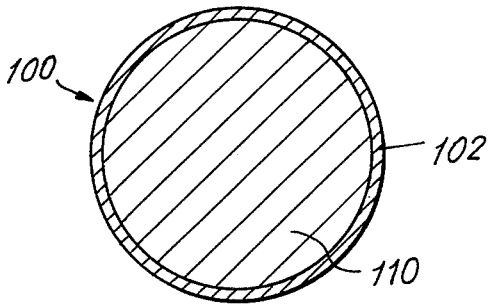
FIG. 2

SECONDARY HIGH EXPLOSIVE BOOSTER, AND METHOD OF MAKING AND METHOD OF USING SAME

FIELD OF THE INVENTION

The field of this invention is explosive boosters, and in a more specific vein, secondary high explosive boosters of such density that the boosters are capable of both accepting a detonation as well as donating it. Such boosters are used, for example, within wellbores in the oil and gas industry.

BACKGROUND OF THE INVENTION

Explosives are substances capable of exerting, by their characteristic high-velocity reactions, sudden high pressures. There are a variety of chemical explosive compounds, each one with characteristics that determine the conditions under which it can advantageously be used. Accordingly, a particular explosive compound may be more desirable for use in one situation than in another, and a different explosive compound will be better suited for use under the other situation's conditions. However, all types of explosives have at least one characteristic in common: they require some sort of activation, by application of one or more externally supplied stimuli such as heat, flame, electrical discharge, impact or shock to initiate their explosive reactions. It nonetheless confirms the diversity of explosives that their sensitivities to the aforementioned stimuli vary from one to another, and vary even for a given explosive under different conditions of temperature, pressure, concentration, density and physical state. Chemical explosives are divided into two main categories, the "low" or "deflagrating" type and the "high" or "detonating" type. The latter are further classified as "primary" or "secondary" high explosives.

The present invention has to do principally with the employment of high explosives in the oil and gas industry. Such high explosives are characterized by their exhibition, when appropriately stimulated, of an explosive reaction which takes place within a high-velocity shockwave known as the "detonation wave" or "reaction shock period". This wave generally propagates at a constant velocity, typically faster than the speed of sound in the high explosive material, depending on the chemistry of the explosive, its density and its physical state. Pressures generated by detonation range up to several millions of psi.

Primary high explosives are used to detonate other high explosives. The reaction in a primary high explosive is typically initiated by a relatively weak mechanical shock or by a spark. Such explosives first burn or deflagrate for a few micro-seconds, then detonate. The treatment and handling of primary high explosives require great care. This is due to their high sensitivity and thus tendency to detonate prematurely, and their tendency towards degradation (through oxidation) when exposed to high temperatures over a period of time.

Secondary high explosives are used in preference to primary high explosives whenever possible. Secondary high explosives are advantageous because they yield higher outputs of energy than primary high explosives. Also, unlike primary high explosives, they can only be detonated in response to (1) a shock wave moving faster than the speed of sound therein, or (2) a deflagration thereof which is transformed into a detonation by confinement of the deflagrating high explosive leading to a sufficient pressure increase accompanied by a sufficiently increased burn rate. In the absence of such stimuli they are relatively stable. Detonation of a secondary high explosive depends in large measure on its confinement, the rate of heat dissipation, and the nature of the explosive itself.

High explosive charges of the secondary type have many different applications in the oil and gas industry; typical uses include perforating a well casing to complete or test a formation, severing tubing in a wellbore, breaking up unretrievable junk downhole and extinguishing fires at wild wells. Due to the time and expense involved in carrying out such operations, and to the power of the explosives, it is essential that the performance of the explosives be as safe and reliable as possible. Furthermore, it is important that secondary high explosive materials be resistant to the extremes of temperature encountered in the typical wellbore environment lest such conditions degrade the operation of those materials.

It is frequently the case that such secondary explosives must be detonated downhole with the aid of a booster, an explosive component ordinarily interposed between two secondary high explosive masses to transmit a detonation from one to the other. Unfortunately, the utilization of conventional boosters has proven to be a long-standing and significant problem in the art, wherein lies the genesis of the present invention.

By way of illustration, a typical use of conventional boosters and the problems engendered by it are discussed below.

It is the ordinary practice of those in the oil and gas industry to utilize secondary high explosives in the form of a plurality of discrete charges set in a tube of appropriate material known as a perforating gun; while it may vary, the gun's length is typically fourteen feet. A detonating cord made of secondary high explosive sheathed in an insulating material such as, for example, lead, glass fibers, aluminum or nylon, is intertwined with the charges from one end of the gun to the other to transmit a detonation from one charge to another, along the entire length of the tube. As those of ordinary skill in the art will appreciate, the intra-gun transfer of detonation from charge to charge works well enough; all of the charges as well as the detonating cord comprise safe, reliable secondary high explosive. Thus, proper operation even under extreme conditions downhole is by and large theoretically ensured.

However, in practice the aforementioned guns are quite often not used singly, but rather, in the form of a string of guns secured to one another in succession. Such a string is lowered down a borehole in order to perform the various functions mentioned above as those for which secondary high explosives are typically used; it is not unusual for the string to be one thousand to two thousand feet long. Initially, the component guns in that string are attached to one another by couplings so that the detonation cords within adjacent guns are in effective abutment, thereby permitting transfer of a detonation from the first gun to the second gun by transmitting the detonation from one detonating cord to the other. But, due to the length of the string and weight of its component guns, as the string is lowered into the hole it stretches, and the component guns pull apart from one another, or "space out", leaving air gaps between adjacent guns.

Therefore, a booster is coupled to each of the opposed ends of the two detonating cords. This is done to enable the transfer downhole of a detonation from the detonating cord of one perforating gun to the detonating cord of an adjacent gun. It is the utilization of boosters in connection with secondary high explosives which raises the basic difficulties addressed by the present invention.

At one time, conventional boosters were all of uniform construction, each including a charge of primary high explosive such as lead azide positioned at the innermost extremity of a metal cup, with an adjacent charge of secondary high explosive. Such boosters were bidirectional in the sense that each could act equally well as a donor or acceptor. However, the use of these boosters was disadvantageous (to say the least) due to their extreme sensitivity to shock or spark.

Subsequently, there were developed the currently employed conventional boosters, which can be classified into two basic types: donor boosters and acceptor boosters.

A donor booster must be capable of transmitting a detonation across a discontinuity such as an air gap. It does this by its own detonation in response to the detonation of an adjacent secondary high explosive mass, the donor booster's detonation yielding a sufficiently high output to enable transmission across the air gap or the like. Because of the output requirements, a donor booster is typically composed of *secondary* high explosive; such conventional secondary boosters cannot "pick up" a detonation over any discontinuity, for example, an air gap. This means that the donor booster and the detonating cord to which it is coupled must be in *intimate* contact.

An acceptor booster, on the other hand, is one which will detonate in response to another detonation, i.e., in response to the detonation of a donor booster which may be spaced from the acceptor booster by a discontinuity such as an air gap; the acceptor booster is further capable of detonating another secondary high explosive mass in operative association with it by means of the booster's own detonation. Thus, an acceptor booster "picks up" a detonation from a donor booster, even across a discontinuity, and transmits the detonation to another secondary high explosive mass so as to "continue" the detonation. Therefore, to "continue" the detonation, it is essential that an acceptor booster detonate, and not merely deflagrate.

A conventional acceptor booster usually has two stages; a primary high explosive stage and a secondary high explosive stage. The secondary high explosive stage is located adjacent a detonating cord, and the primary high explosive stage is located adjacent the secondary high explosive stage. The primary high explosive stage "picks up" a detonation, e.g., across an air gap (due to heat, shock or the like stimulus generated by the detonation) and detonates itself; such detonation in turn causes the secondary high explosive stage to detonate which in turn causes the above-mentioned detonating cord (or other adjacent secondary high explosive mass) to detonate.

From the foregoing, the necessity of placing conventional donor and acceptor boosters in proper sequence, and the drawback of this sequencing requirement, are apparent. If the donor booster is placed out of sequence in the position of the acceptor booster, a detonation will not be accepted by the donor booster should any sort of discontinuity be interposed between it and the detonation—as is virtually always the case. This will terminate the progression of the detonation. The problem is a substantial one due to the fact that conventional donors and acceptors are normally housed in look-alike aluminum containers, thereby creating a probability that a donor will be placed where an acceptor ought to be.

An additional significant drawback to the use of conventional boosters is the incorporation therein of the primary high explosive stage, for instance lead azide or a related compound. Lead azide, and other primary high explosives, are highly sensitive to shock and heat and accordingly are subject to possible premature detonation with self-evident detrimental consequences. Additionally, the exposure of lead azide to high temperatures over a period of time will result in its degradation through oxidation. For example, exposure of lead azide to a temperature of 437° F. or more for a period of 100 hours or more will result in a loss of effectiveness. This shortcoming of lead azide is particularly significant when working in deep wells. As the string of perforating guns is made up at the well-head it is gradually lowered down the borehole; the deeper the well the longer the string, and thus the longer the dwell-time of the string downhole (until make-up of the entire string is completed) prior to detonation. Furthermore, the deeper the well the higher the temperature encountered at its lower depths. These factors combine to increase time-at-temperature exposure to a dangerously high degree. It is therefore desirable to avoid the use of lead azide and other similar primary high explosives whenever possible.

A secondary high explosive booster capable of both receiving a detonation across a discontinuity and continuing the detonation downline would confer clear advantages, such as obviation of the sequencing requirement of conventional acceptor and donor boosters, high stability and high output. It would eliminate the previously discussed problems associated with use of primary high explosives. Provision of such a booster would be a highly desirable advance over the current state of technology.

OBJECTS OF THE INVENTION

It is an object of this invention to provide a secondary high explosive booster of such density that it is capable of accepting (receiving and continuing) a detonation, as well as donating (transmitting) same, across a gap.

It is also an object of this invention to provide a secondary high explosive booster of such density that it is capable of receiving a detonation from another secondary high explosive across a discontinuity of up to about 2.5 inches, which discontinuity may, for instance, be caused by down-hole spacing out of component perforating guns in a string thereof.

It is an additional object of this invention to provide a secondary high explosive booster which is non-directional and obviates the requirement for proper sequencing of conventional acceptor and donor boosters.

It is yet another object of this invention to provide a method for making the secondary high explosive booster of the invention.

It is still another object of this invention to provide a method whereby a detonation is transferred from one secondary high explosive mass to another without the use of conventional boosters.

These and other objects and advantages of the present invention will become more readily apparent after consideration of the following.

STATEMENT AND ADVANTAGES OF THE INVENTION

The present invention is directed, inter alia, to an explosive booster (as an article of manufacture), which comprises a secondary high explosive material of such density that the secondary high explosive material is capable of receiving a detonation from one secondary high explosive mass, across a discontinuity, and then detonating and transmitting the detonation to another secondary high explosive mass.

In still another aspect, the invention is directed to a method of making a secondary high explosive booster. That method comprises compacting a secondary high explosive material to a density such that the booster is capable of receiving a detonation from another secondary high explosive mass across a discontinuity interposed between the booster and said other mass, of detonating in response to said received detonation, and of transmitting said responsive detonation to yet another secondary high explosive mass to effect detonation thereof.

In a further aspect, the invention is directed to a method of transferring detonation from one secondary high explosive mass to another such mass, said masses being separated by a discontinuity, which comprises locating in operative association with said secondary high explosive masses an explosive booster means including secondary high explosive material of a density such that the explosive material is capable of receiving a detonation across said discontinuity; transmitting a detonation from said one secondary high explosive means to said booster means; detonating said booster means in response to said transmitted detonation, and detonating said other secondary high explosive mass in response to the detonation of said booster means.

As evident from the foregoing, numerous advantages accrue with the practice of the present invention. The above-described explosive booster eliminates the need for an unstable primary high explosive, since the new secondary high explosive composition can be detonated directly from the output of a donor booster (composed of secondary high explosive) across a discontinuity without the need of a primary high explosive charge. Additionally, the invention provides a stable booster which is resistant to degradation under severe downhole conditions. These are features ideally suited for solution of the operational problems resulting from the great depths of, and extreme temperatures in, wellbores which are typical of current practice.

In the following section, the invention is described in greater detail to illustrate several of its embodiments.

BRIEF DESCRIPTION OF THE DRAWINGS

FIG. 1 is a cross-sectional view of a final assembly suitable for housing the single stage secondary high order explosive booster of the present invention.

FIG. 2 is a cross-section taken along line 2—2 in FIG. 1.

DESCRIPTION OF CERTAIN PREFERRED EMBODIMENTS

Figure 3:
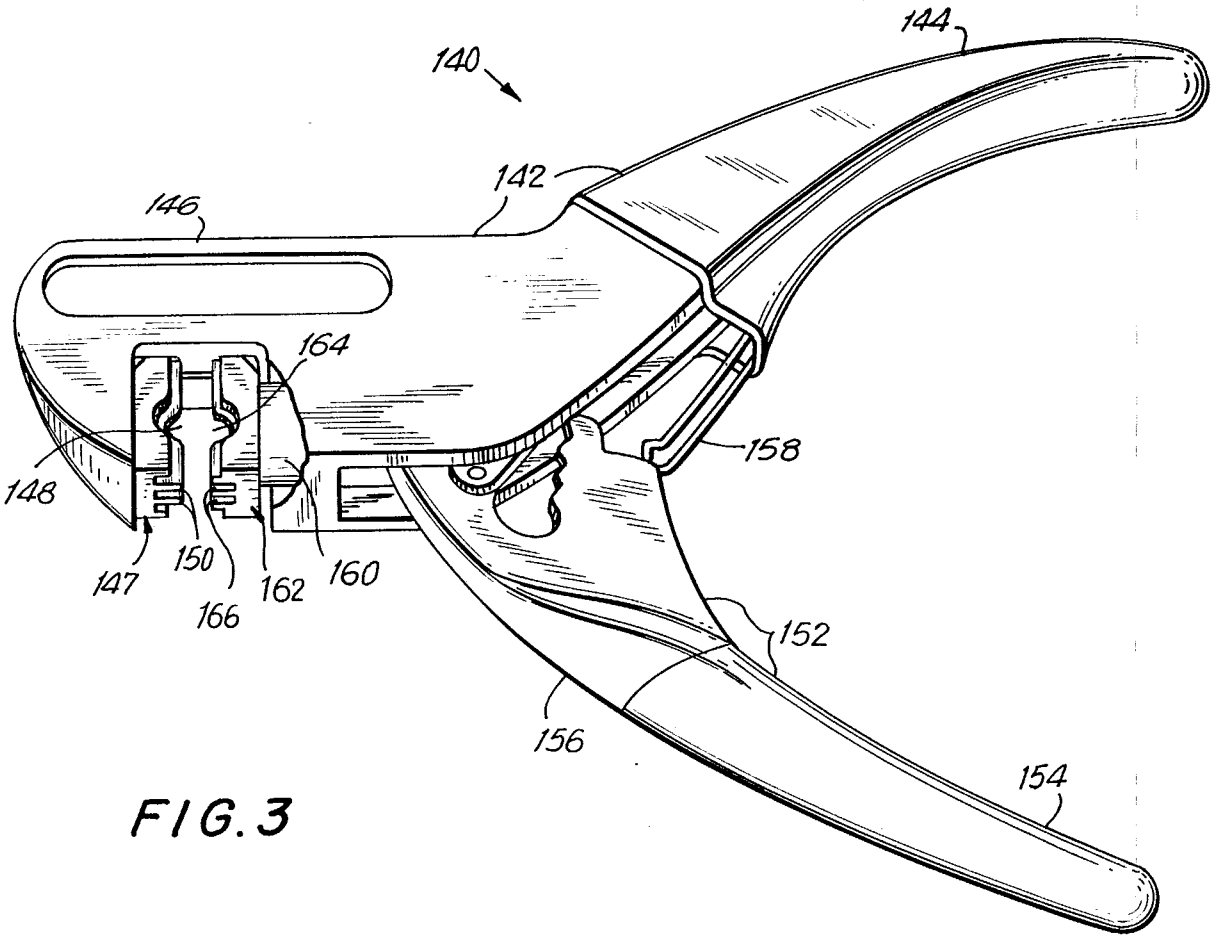
FIG. 3 is a perspective of a crimping tool used with the booster of this invention.
Figure 4:
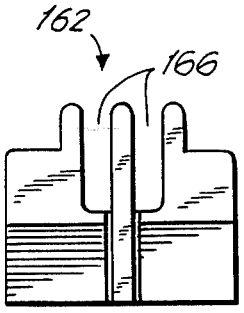
FIG. 4 is an end view of the female jaw of the crimping tool shown in FIG. 3.
Figure 5:
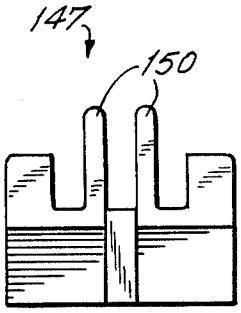
FIG. 5 is an end view of the male jaw of the crimping tool shown in FIG. 4.

The provision of a secondary high explosive booster which, in addition to yielding a large detonating output (i.e., acting as a donor), can be detonated by the detonation of another secondary high explosive spaced from it by a gap (i.e., act as an acceptor) is dependent upon incorporation in the booster of the secondary high explosive of a density such that those dual capabilities are conferred. It is attainment of such density which results in a particularly advantageous feature of the invention, namely that the booster in accordance therewith is able to accept and continue a detonation across a discontinuity, such as an air-gap of up to 2.5 inches (as often encountered in wellbores).

In accordance with the invention the density of a booster's constituent secondary high explosive is a function of the identity of the secondary high explosive material (for instance, HMX or PYX), and the particle size of the material which is compacted to form the booster's explosive component. Accordingly, as will be appreciated by those of ordinary skill in the art, there is no one density or range of densities which will result in the achievement of the desired attributes of the booster of the invention for all possible secondary high explosives. Rather, the appropriate density or range of densities will likely as not vary from one combination of the aforementioned conditions (the secondary explosive material's identity and particle size) to another. This is thought to result at least in part from the fact that a secondary high explosive material characterized by one set of such conditions may well differ in sensitivity to stimulus resulting in detonation from a secondary high explosive material characterized by a different set of such conditions; different sensitivities dictate the utilization of different densities to achieve a comparable result. For any particular set of such conditions it may be necessary to determine the density or densities which yield the desired attributes empirically. However, this is well within the skill of the art and does not require inventive experimentation, especially in light of the disclosure herein. This is aptly illustrated by the following.

It has been found that under the conditions:

identity of secondary high explosive: HMX particle size: 98% of the particles being less than 45 microns, which particle size is determined by 98% of the HMX passing through a 325 mesh sieve a density of the secondary high explosive which results in the achievement of the desired characteristics of the invention is 1.71 g./cc.; but for the conditions:

identity of secondary high explosive: PYX particle size: 100% of the particles being less than 45 microns, which particle size is determined by 100% of the PYX passing through a 325 mesh sieve a density of the secondary high explosive which results in achievement of the desired characteristics of the invention is 1.45 g./cc.

The preceding information demonstrates that the density or a range of densities for the secondary high explosive which should be attained in accordance with the invention is particular to any one set of conditions and that density or range of densities can vary from one set of conditions to another. Accordingly, as discussed above, in order to determine what particular density or range of densities are suitably employed it may be necessary for those of ordinary skill in the art to utilize an empirical procedure, i.e., to test materials of different densities until one or more acceptable densities are found.

While the skilled artisan is capable of devising appropriate test methods, one particular example which has been found useful is the so-called gap-test. In that method a series of tests runs is performed. For each test run there is provided a secondary high explosive mass (such as a piece of a detonating cord) which will be detonated during testing, that mass being spaced a predetermined distance from a secondary high explosive material compacted to a known (or at least ascertainable) density. In the series of test runs the gaps are varied from run to run in incrementally increasing or decreasing fashion, and/or the density of the secondary high explosive material is varied from run to run in incrementally increasing or decreasing fashion. In each test run, the secondary high explosive mass is detonated in order to determine whether or not that detonation is accepted across the gap by the compacted secondary high explosive material, i.e., whether or not the initial detonation causes the compacted material to detonate also. In the foregoing manner, a pattern of relative sensitivities over a range of different densities is determined. The pattern will conceivably vary from no appreciable sensitivity (regardless of gap size) at certain densities, to some slight sensitivity (detonation accepted over a small gap or gaps) at certain other densities, to high sensitivity (detonation accepted over a large gap or gaps) at one or several other densities.

As previously discussed, the requisite density is achieved in accordance with the invention by applying to an increment of secondary high explosive material a compaction pressure sufficient to compress the starting material into the desired explosive booster mass. The secondary high explosive material from which the booster is made is typically utilized in particulate form. The size of the particles employed can vary over a wide range without departing from the invention; such variation is however likely to cause a corresponding variation in the density or range of densities which confer "acceptor" capability on the booster (all other things being equal). Typical particle sizes are, for an HMX sample, 98% of the particles less than 45 microns (−325 mesh), and for a PYX sample, 100% of the particles less than 45 microns (−325 mesh). In situations where economies of cost are not an over-riding factor, the use of a gradient of particle sizes facilitates contact of particles and minimizes void space in the compacted booster explosive, and is thus especially helpful.

The compaction pressure necessary to obtain the required density (and, thus, the desired ability to act as a detonation acceptor across a gap) under any given specific set of circumstances will depend on the identity of the explosives employed and the precursor particle size of the secondary high explosive component. Compaction is typically accomplished by pressing the powder with a ram to form a pellet, or by any other known method of consolidation of powder particles which provides the requisite amount of compaction pressure. One skilled in the art will be able to adapt known methods of compaction to achieve the particular density needed to yield the desired sensitivity of the booster explosive material.

It should be noted that the use of too great a compaction pressure, and therefore the attainment of too high a density for the booster explosive material will result in a booster that does not accept the detonation due to its being to insensitive to detonation stimulus.

Also, too low a compaction pressure may result in a booster explosive material which for example has an excess amount of voids and thus too low a density. That condition will impair the booster's performance, as it leads to erratic and undependable detonation.

With reference to the previously presented examples, the compaction pressures applied to obtain the density reported demonstrate processing in accordance with the invention. Thus, to attain a density of 1.71 g./cc. with HMX wherein 98% of the particles are less than 45 microns, a pressure of 45,000 psi applied. To obtain a density of 1.45 g./cc. with PYX wherein 100% of the particles are less than 45 microns, a pressure of 30,000 psi was applied.

As will be apparent, just as the suitable density or range of densities for booster explosive material in accordance with invention varies based on the identity of the secondary high explosive and the material's particle size, so does the compaction pressure for achieving that density vary. However, as previously discussed, appropriate compaction pressures can be derived empirically by those of ordinary skill in the art for each particular secondary high explosive, and particle size, without undue experimentation. Again, the gap test is an example of a way to ascertain the compaction pressure which produces an explosive material of suitable density for employment in the inventions; the practitioner of the invention may ultimately use other test procedures which are within his ordinary skill to devise and which yield comparable information.

Compaction of a secondary high explosive in suitable precursor form (such as a powder) to attain the requisite density is typically carried out within an elongated cylindrical cup. The cup may be made up of aluminum, stainless steel, or copper/bronze alloy such as gilding metal.

Of course, as will be appreciated the design of the cup itself in some embodiments will have an influence on the compaction pressure which is employed to achieve a desired density. Illustratively, the bottom of the cylindrical cup may be formed with either a conical dimple or a slightly reduced wall thickness in the center area of the bottom of the cup. Use of either of these methods of cup construction serves to concentrate the output produced by the explosive contained within the cup. After compaction, the booster explosive material advantageously exhibits a density which is substantially uniform throughout, that density of course being one which confers the capability of acting as an acceptor of an extraneous explosive reaction. The achievement of sufficiently uniform density is advantageously effected by maintaining the length to diameter ratio of the uncompacted explosive within the cup at less than or equal to 1 prior to compaction of the explosive.

In certain embodiments the booster explosive material is suitably formed of a plurality of compacted increments, or pellets, of constituent secondary high explosive material. In such cases, the achievement of uniform density is promoted by following the aforementioned length to diameter relationship. Accordingly, the number of compacted increments of material which advantageously ultimately constitute the substantially uniformally dense booster secondary high explosive is a function of the relationship between the diameter of the tube in which compaction is carried out and the amount of explosive used to make the booster.

Thus, if the amount of explosive is sufficiently small and the diameter of the cup sufficiently large, compaction of only a single increment of explosive material is necessary since the "length" of the material charged into the cup will be less than or equal to the relevant diameter, thereby yielding a length:diameter ratio of 1 or less. However, if the amount of material is more than can be deposited all at once in the cup while still observing a length:diameter ratio of no more than 1, then the material is compacted in as many increments as is necessary to ensure that the length:diameter ratio never exceeds 1.

When faced with the compaction of a plurality of increments of explosive material to form the booster, compaction can be effected as follows. Compaction of three increments is illustrative. A first increment of the explosive material is introduced (e.g., poured) into the cup and compacted at a desired pressure for a time sufficient to yield the desired density. Next, the second increment of constituent explosive is introduced, on top of the first, and both are compacted. Finally, a third increment of explosive is added to the first two compacted increments and all three compacted together. Following this procedure typically yields one integral body of the explosive material; it is generally advantageous that each compacted increment is joined to its neighbor(s). However, it is also within the scope of the invention that the booster explosive material is made up of two or more discrete masses.

In order to illustrate the invention further, it is noted that two particularly advantageous embodiments are as follows: (as an article of manufacture) an explosive booster which comprises (e.g., 900 mg. of) the explosive HMX which has been compacted at a pressure of 45,000 psi in three increments to a density of 1.71 g./cc., such that this compaction in three increments results in a single material of uniform density throughout; (as an article of manufacture) an explosive booster, which comprises (e.g., 795 mg. of) the explosive PYX which has been compacted at a pressure of 30,000 psi in three increments to a density of 1.45 g./cc., which compaction in three increments results in a single material of uniform density throughout.

In yet another aspect, the invention is directed to the explosive booster assembly which includes a housing for the compacted secondary high order explosive material. A detailed description of devices suitable for housing the booster appears from the following text and referenced in FIGS. 1 and 2.

In FIG. 1 is depicted booster assembly 100, which contains a secondary high explosive which is compacted within an elongated, generally cylindrical cup 102. The cup has two ends 104 and 106. The cup has a length of 1.375 inches and a diameter of 0.24 inches. The cup may be made of aluminum, stainless steel or a copper/bronze alloy such as guilding metal.

A first compacted increment of secondary high explosive 108 abuts end 106 and the wall of the cylindrical cup 102. A second compacted increment of secondary high explosive 110 abuts increment 108 and wall 102. A third compacted increment of secondary high explosive 112 abuts second increment 110 and wall 102.

FIG. 2 shows a cross-section of the booster assembly. The thickness of cup wall 102 is 0.008 inches. The wall circumferentially surrounds the booster charge, which in this case is the second compacted increment.

The invention also provides a method which is particularly well-suited for transmitting a detonation between two secondary high explosive charges, especially two such charges separated by an air gap. This results from the inventive booster's capacity for both accepting and donating a detonation. The method is highly advantageous for utilization in connection with the sequential detonation of a string of so-called perforating guns in a wellbore. As previously explained, the component guns become spaced out when they are lowered down a wellbore, and the present method employing the inventive booster enables the detonation to move along the string, jumping air gaps between adjacent guns which would otherwise impede or bar its progress.

The inventive boosters are interposed between adjacent secondary high explosive charges in any appropriate conventional manner. For example, when employing the boosters to aid in the detonation of a string of perforating guns, a booster can be located in abutment with the detonating cord of one such gun and a booster located in abutment with the corresponding opposed end of a detonation cord of an adjacent gun. The detonation is transferred from the first cord to its abuting booster, which then detonates itself. That detonation is donated even across a discontinuity (for example an air gap) of up to 2.5 inches to the next booster, which in turn accepts the detonation, detonates itself and then donates the detonation to the cord of such adjacent gun. In certain embodiments, two or more boosters will be necessary, depending on the size of the gap (or other discontinuity) to be jumped, and other downhole conditions. One of ordinary skill, equipped with the instant teachings, will be able to practice the invention without undue experimentation regarding the number of boosters necessary, location of the boosters in operative association with the charges to be detonated, and the like.

The booster of the invention is thus typically utilized in the cup in which it is formed. It is advantageously attached to a detonating cord using a crimping device to pinch the open end of the cup closed around the cord. This measure seals the booster explosive material within the cup against intrusion of all external liquids, and is carried out so as to provide a moisture barrier protecting the explosive material from downhole conditions. In this connection, it has been found that the following device, a specialized crimping tool, is particularly advantageous.

The crimping tool 140 has a handle 142 which handle has a grip portion 144 and a head portion 146. A male jaw 147 is mounted on the head portion 146. The male jaw 147 has a semi-circular notch 148 and two projecting ridges 150. The ridges 150 run transversely of, and follow the curve of, the notch 148. The tool 140 also has a second handle 152 which has a grip portion 154 and a head portion 156. The two handles 142 and 152 are pivotably engaged so that they are movable toward and away from one another. Spring 158 is positioned so as to bias against head 156 of handle 152. Spring 158 maintains the handles 142 and 152 in an open position when the tool 140 is not in use. A movable cylinder 160 is positioned within head 146 and is adjacent to head 156. The cylinder 160 incorporates a female jaw 162. The female jaw 162 has a semi-circular notch 164 and two grooves 166 which are capable of receiving ridges 150. The grooves 166 run transversely of, and follow the curve of, the notch 164. The cylinder 160 and the head 156 of handle 152 are positioned so that when handles 142 and 152 are pressed together, cylinder 164 and female jaw 162 move by cam motion towards male jaw 147.

In actual use, the booster to be crimped to the detonating cord is placed between the open jaws 147 and 162 in the vicinity of the semi-circular notches 148 and 164. As the handles 144 and 154 are pressed together, the cylinder 160 and the female jaw 162 move by cam motion towards male jaw 147. The jaws 162 and 147 move to mesh ridges 150 with grooves 166, thereby crimping the booster. The tool 140 produces a precise round, non-elliptical crimp, which securely affixes the booster to the detonating cord without distorting the overall shape of the booster housing, while producing a hermetic seal.

Further objects of the invention, together with additional features contributing thereto and accruing therewith, will be apparent from the following examples of the invention.

EXAMPLE 1

300 mg. of the explosive HMX is poured into a elongated cylindrical cup of the housing assembly as illustrated in FIGS. 1 and 2. This 300 mg. is compacted at a pressure of 45,000 psi to an average density of 1.71 g./cc. Next another 300 mg. of the explosive HMX is poured into the cylindrical cup and consolidated at a pressure of 45,000 psi to an average density of 1.71 g./cc. Finally, another 300 mg. of the explosive HMX is poured into the elongated cylindrical cup and consolidated at a pressure of 45,000 psi to an average density of 1.71 g./cc. This compaction in three stages results in a single material of the average density of 1.71 g./cc. This density has been carefully selected so that the explosive acts both as acceptor and donor of the explosive reaction (as can be readily ascertained by employment of the gap test).

EXAMPLE 2

265 mg. of the explosive PYX is poured into a elongated cylindrical cup and compacted at a pressure of 30,000 psi to an average density of 1.45 g./cc. Next, another 265 mg. of the explosive PYX is poured into the same elongated cylindrical cup and consolidated at a pressure of 30,000 psi to an average density of 1.45 g./cc. Finally another 265 mg. of the explosive PYX is poured into the elongated cylindrical cup and consolidated at 30,000 psi to an average density of 1.45 g./cc. This compaction in three stages yields a single material of an average density of 1.45 g./cc., which density has been carefully selected so that the explosive acts both as acceptor and donor of the explosive reaction (as can be readily ascertained by employment of the gap test).

From the foregoing, it can be seen that the invention provides a booster, method of making same and method of using same which are truly significant. The invention offers a safe and reliable alternative to the use downhole of boosters containing unpredictable, unstable, often deadly primary high explosives. Furthermore, the present invention provides a booster which overcomes the unidirectionality of conventional acceptor boosters; this is of great importance in eliminating interruption of detonation downhole due to improper sequencing of such conventional boosters.

Of great additional importance is that, because of its bidirectionality, the booster of the invention is—unlike conventional boosters—ideally suited for use in a redundant firing system. In a redundant firing system, a second firer, for example, a time-delayed firer which is electrically or pressure activated, is affixed to the downhole end of the string of charges. In this manner, simultaneous detonation may be initiated at both ends of the string. This type of system, wherein detonation is initiated along the string from both directions has the advantage of permitting detonation of an entire string of charges even if there exists therein a defect which is a barrier to the transfer of detonation in either direction individually; it also lessens the likelihood of deflagration. It will be clear that, in such a redundant firing system, a bi-directional booster is essential, since by its very nature, a redundant firing system requires two detonations to travel simultaneously in opposite directions along the string. Thus conventional unindirectional boosters will not operate a redundant firing system; the bidirectional booster of the instant invention is essential.

These features evidence the technical advance realized with the present invention.

It will be appreciated that the present invention is not limited to application within the oil and gas industry, but finds ready application in such other diverse applications as the mining and construction industries, among others.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

I claim:

1. An explosive booster, which comprises a secondary high explosive material of HMX having an average density of from 1.2 to 1.7 g./cc. such that the material is capable of receiving a detonation from another explosive material across a discontinuity interposed between the booster and said other explosive material to be detonated, capable of detonating in response to said received detonation, and capable of transmitting said responsive detonation to yet another secondary high explosive mass to effect detonation thereof.

2. An explosive booster as defined in claim 1, wherein the secondary high explosive material in said booster is the form of at least one pellet, each said pellet having an average density which is a function of the identity of the secondary high explosive material and the size of the particles of said secondary high explosive material compacted to make said pellet.

3. An explosive booster as defined in claim 1, wherein the discontinuity is an air gap of up to 2.5 inches.

4. An explosive booster as defined in claim 2, wherein the booster comprises a plurality of said pellets, each pellet being integral with each other pellet adjacent thereto.

5. An explosive booster, which comprises a secondary high explosive material of PYX having an average density of from 1.2 to 1.45 g./cc. such that the material is capable of receiving a detonation from another explosive material across a discontinuity interposed between the booster and said other explosive material to be detonated, capable of detonating in response to said received detonation, and capable of transmitting said responsive detonation to yet another secondary high explosive mass to effect detonation thereof.

6. A explosive booster as defined in claim 1, which comprises the explosive HMX compacted at a pressure of 45,000 psi, in three increments, to a density of 1.71 g./cc, which density is uniform throughout.

7. A explosive booster as defined in claim 1, which comprises the explosive PYX compacted at a pressure of 30,000 psi, in three increments, to a density of 1.45 g./cc, which density is uniform throughout.

8. A method for producing an explosive booster capable of accepting a detonation, which comprises compacting an increment of secondary high explosive material of HMX secondary high explosive material having a particle size of less than 45 microns at a pressure of from 5,000 psi to 45,000 psi to a density such that the booster is capable of receiving a detonation from another secondary high explosive mass across a discontinuity interposed between the booster and said other mass, capable of detonating in response to said received detonation, and capable of transmitting said responsive detonation to yet another secondary high explosive mass to effect detonation thereof.

9. A method for producing an explosive booster capable of accepting a detonation, which comprises compacting an increment of secondary high explosive material of PYX secondary high explosive material having a particle size of less than 45 microns at a pressure of from 5,000 psi to 30,000 psi to a density such that the booster is capable of receiving a detonation from another secondary high explosive mass across a discontinuity interposed between the booster and said other mass, capable of detonating in response to said received detonation, and capable of transmitting said responsive detonation to yet another secondary high explosive mass to effect detonation thereof.

10. A method as defined in claim 8, which comprises combining said compacted increment with a second increment of secondary high explosive and subjecting the two together to compaction pressure, and then combining the two compacted increments with a third increment of secondary high explosive and subjecting all three together to compaction pressure.

11. A method as defined in claim 8, which comprises compacting a plurality of increments of secondary high explosive material.

12. A method as defined in claim 8, wherein each said increment is shaped as a cylinder having a length: diameter ratio of up to 1.

13. An explosive booster adapted to be affixed to a secondary high explosive mass, said booster comprising a housing and disposed therein a secondary high explosive material of HMX having an average density of from 1.2 to 1.7 g./cc. such that the booster is capable of receiving a detonation from another explosive material across a discontinuity interposed between the booster and said other explosive material to be detonated, capable of detonating in response to said received detonation, and capable of transmitting said responsive detonation to yet another secondary high explosive mass to effect detonation thereof.

14. An explosive booster as defined in claim 13, wherein the secondary high explosive material in said booster is in the form of at least one pellet, each said pellet having an average density which is the function of the identify of the secondary high explosive material and the size of the particles of said secondary high explosive material compacted to make said pellet.

15. An explosive booster as defined in claim 13, wherein the discontinuity is an air gap of up to 2.5 inches.

16. An explosive booster adapted to be affixed to a secondary high explosive mass, said booster comprising a housing and disposed therein the secondary high explosive material PYX having an average density of from 1.2 to 1.45 g./cc. of density such that the booster is capable of receiving a detonation from another explosive material across a discontinuity interposed between the booster and said other explosive material to be detonated, capable of detonating in response to said received detonation, and capable of transmitting said responsive detonation to yet another secondary high explosive mass to effect detonation thereof.

17. An explosive booster as defined in claim 14, wherein the booster comprises a plurality of said pellets, each pellet being integral with each other pellet adjacent thereto.

18. An explosive booster as defined in claim 5, wherein the secondary high explosive material in said booster is the form of at least one pellet, each said pellet having an average density which is a function of the identity of the secondary high explosive material and the size of the particles of said secondary high explosive material compacted to make said pellet.

19. An explosive booster as defined in claim 5, wherein the discontinuity is an air gap of up to 2.5 inches.

20. An explosive booster as defined in claim 18, wherein the booster comprises a plurality of said pellets, each pellet being integral with each other pellet adjacent thereto.

21. An explosive booster as defined in claim 16, wherein the secondary high explosive material in said booster is in the form of at least one pellet, each said pellet having an average density which is the function of the identity of the secondary high explosive material and the size of the particles of said secondary high explosive material compacted to make said pellet.

22. An explosive booster as defined in claim 13, wherein the discontinuity is an air gap of up to 2.5 inches.

23. An explosive booster as defined in claim 22, wherein the booster comprises a plurality of said pellets, each pellet being integral with each other pellet adjacent thereto.

* * * * *